US006445562B1

(12) United States Patent
Hahne et al.

(10) Patent No.: US 6,445,562 B1
(45) Date of Patent: Sep. 3, 2002

(54) METHOD AND DEVICE FOR ELECTROSTATIC CHARGING

(75) Inventors: Ernst August Hahne, Allschwil (CH); Hermann Künzig, Wil am Rhein; Franz Knopf, Bühl, both of (DE)

(73) Assignee: Eltex-Eeektrostatik GmbH, Weil am Rhein (DE)

( * ) Notice: Subject to any disclaimer, the term of this patent is extended or adjusted under 35 U.S.C. 154(b) by 0 days.

(21) Appl. No.: 09/402,253

(22) PCT Filed: Mar. 31, 1998

(86) PCT No.: PCT/EP98/01855

§ 371 (c)(1),
(2), (4) Date: Jan. 28, 2000

(87) PCT Pub. No.: WO98/43905

PCT Pub. Date: Oct. 8, 1998

(30) Foreign Application Priority Data

Apr. 2, 1997 (DE) ..... 197 13 662

(51) Int. Cl.[7] ..... H05F 3/00
(52) U.S. Cl. ..... 361/225
(58) Field of Search ..... 361/225, 226; 427/458, 471, 472, 483, 444, 481; 118/620, 638, 50.1

(56) References Cited

U.S. PATENT DOCUMENTS 4,978,118 A * 12/1990 Kasahara ..... 271/275
5,368,289 A * 11/1994 Iwaki et al. ..... 271/265.01
5,369,424 A * 11/1994 Hori et al. ..... 346/134
6,159,555 A * 12/2000 Hahne et al. ..... 427/458

FOREIGN PATENT DOCUMENTS

JP 378350 * 7/1990

* cited by examiner

*Primary Examiner*—Jessica Han
*Assistant Examiner*—Pia Tibbits
(74) *Attorney, Agent, or Firm*—Antonelli, Terry, Stout & Kraus, LLP

(57) ABSTRACT

The invention is a device which electrostatically charges external sides of at least one moving web. The invention includes a pair of rollers, each roller having an outer coating of limited electrical conductivity and an inner core in contact with the outer coating with the outer coating of each roller being spaced apart to define a gap through which the at least one moving web passes so that the outer coating of each roller contacts one of the external sides of the at least one web to transfer electrical charge from the outer surface coating to the moving web; and a high voltage power supply which applies electrical charge to the outer coating with one polarity of the power supply being grounded and electrically connected to a part of the core and another polarity of the power supply being electrically connected to a corona charging electrode which transfers the electrical charge to the outer coating of each roller.

25 Claims, 4 Drawing Sheets

METHOD AND DEVICE FOR ELECTROSTATIC CHARGING

BACKGROUND OF THE INVENTION

1. Field of the Invention

The invention concerns a method as well as a device for electrostatic charging of both external sides of at least one material web with charges having opposite polarities, prior to the further processing of at least one material web, whereby the at least one material web is guided through the gap of a pair of rollers which are arranged parallel and at a small distance from each other.

2. Description of the Prior Art

Methods and devices for the electrostatic charging of moving webs are known (DE-31 17 419 A1). Several material webs are combined into a strand and only the two external sides are charged by means of a device constructed as corona charging electrodes after the first pair of rollers by means of a high-voltage source of 30 kV.

A disadvantage of this known device is that the charging of the two external sides of the material webs is spatially not well targeted. Thus a large portion of the charged particles stray in the entire region where the charging takes place. The result of this is a poor charging efficiency. In addition, there is the risk that in the case of unfavourable surrounding conditions, the corona charging electrodes become soiled and consequently fail. The cleaning work can be quite considerable.

SUMMARY OF THE INVENTION

The invention is a method and a device of the generic type by which a target is charging with a better efficiency.

According to the invention better charging efficiency is achieved with by electrostatic oppositely poled charging of two external sides of at least one material web in the gap between each roller of a roller pair.

On this occasion the charging of the rollers can be carried out via the surface, in fact by means of a so called contact roller (DE-38 23 739 AI), by means of a stroking brush known per se, a sliding contact or a corona charging electrode.

However, in an appropriate development, in the case of the device of the generic type according to the invention the charging is carried out from the inside by the device formed by the pair of rollers, wherein each roller has over a steel jacket a coating with a limited (so called semi-conductive) electrical conductivity and, for the electrical charging of the coating having the limited electrical conductivity, the steel jacket of each roller can be connected to a positive or negative source of high-voltage. A device according to the invention by virtue of the supply of the charging voltage from the inside of the rollers (especially by the retrofitting of existing equipment), makes possible charging of material webs, preferably of plastic material or paper with a high-voltage source of 3 to 7 kV. Thus operation with voltages which are considerable lower than those of the state-of-the-art is possible. In addition, the charging is carried out exactly in that position which is to be charged, namely on the external sides of at least one material web, resulting in an efficiency which is considerably better than that of the state-of-the-art. Finally, if the corona charging electrodes is omitted, a cleaning operation for them is completely dispensable, so that the operational cost of the equipment will be lower due to fewer shutdowns.

In accordance with the invention, the spindle or the shaft of the roller is connected to the steel jacket in an electrically conductive manner and electrically insulated from the machine frame for the rollers. For the electrical charging of the coating with the limited conductivity, the electric high voltage is applied to the spindle or shaft having a terminal for this purpose. This can be constructed either as a fixed terminal on the spindle or as a thrust bearing arranged on the face of the shaft.

In an advantageous embodiment of the invention, it is also feasible that concentrically to the spindle or shaft of the roller and next thereto, a primary coil is mounted stationarily relative to the machine frame and concentrically to the spindle or shaft of the roller on a face thereof a secondary coil is arranged firmly rotating with the roller and one terminal of the secondary coil is connected to the spindle or shaft and the other terminal is connected to the steel jacket via a rectifier circuit.

It is, however, also feasible for the roller to have, for the purpose of insulation from the machine frame, an electric insulator below the highly conductive steel jacket as well as on both of the roller faces. Electrical charging of the coating of the limited conductivity with high voltage from the high voltage source is carried out using a corona charging electrode. Such a roller can also be used as an impression cylinder in the gravure printing process.

BRIEF DESCRIPTION OF THE DRAWINGS

In the following four embodiments of the invention are explained in detail by referring to the drawings.

DESCRIPTION OF THE PREFERRED EMBODIMENTS OF THE INVENTION

Figure 1:
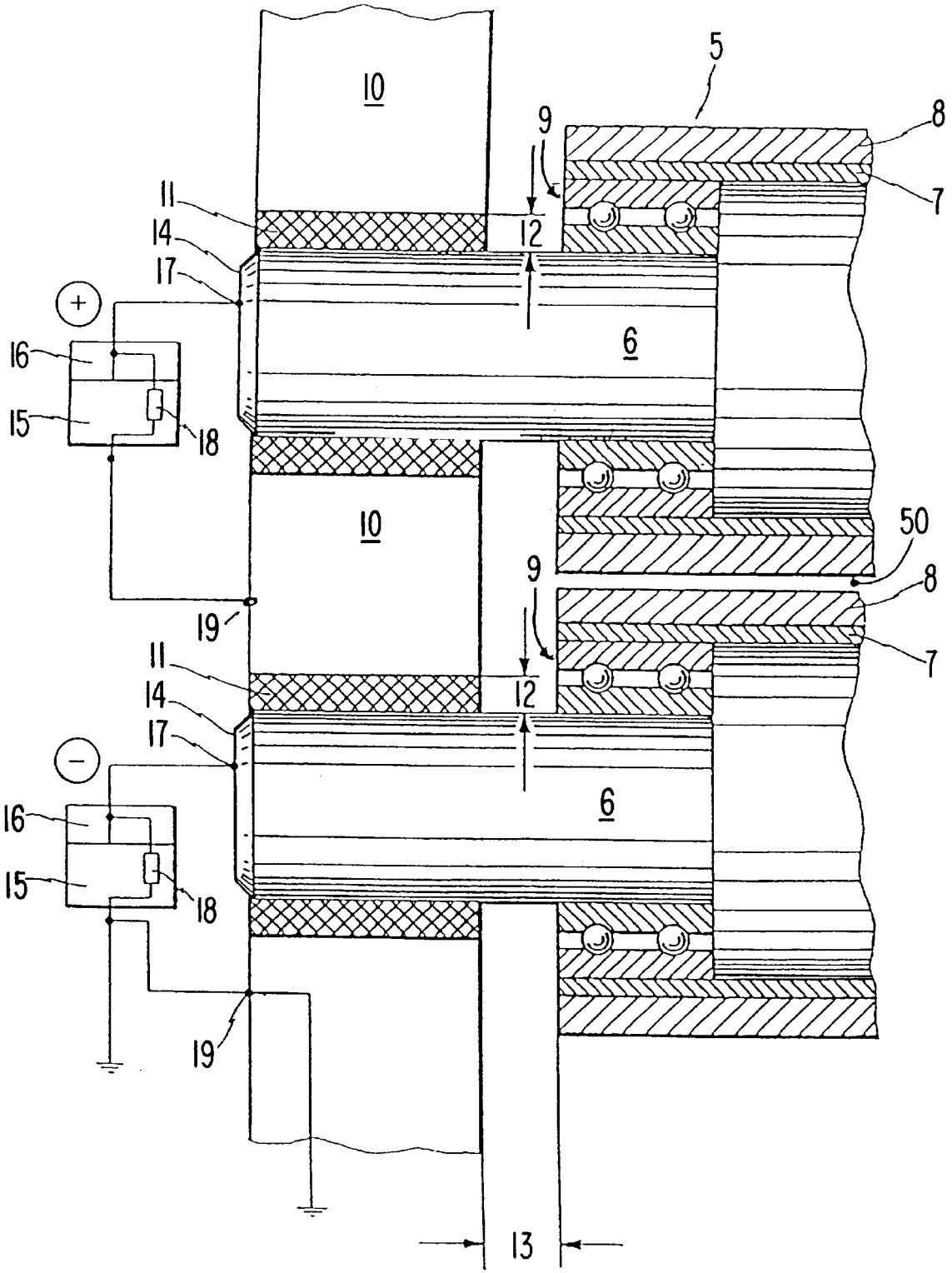
FIG. 1 illustrates a first embodiment of the device according to the invention, with a schematic cross-section and partially truncated illustration.

According to FIG. 1 both rollers 5 have a stationary spindle 6 and a steel jacket 7, on which a coating 8 with a limited conductivity is provided as a surface, which can be electrically charged. Between the spindle 6 and the steel jacket 7, a ball bearing 9 is provided. Between the two parallel rollers a gap 50 is present.

The spindle of the roller 5 is mounted in a machine frame 10 in an electrical insulation 11. The distances 12 and 13 are adequate to prevent discharges or voltage flashovers.

The face 14 of the spindle 6 is connected to a generator 15 and a measuring device 16 via a connection 17, while the wire leading to the connection 17 is grounded via a resistance 18. The machine frame 10 is also grounded, as this is schematically shown by 19.

Figure 2:
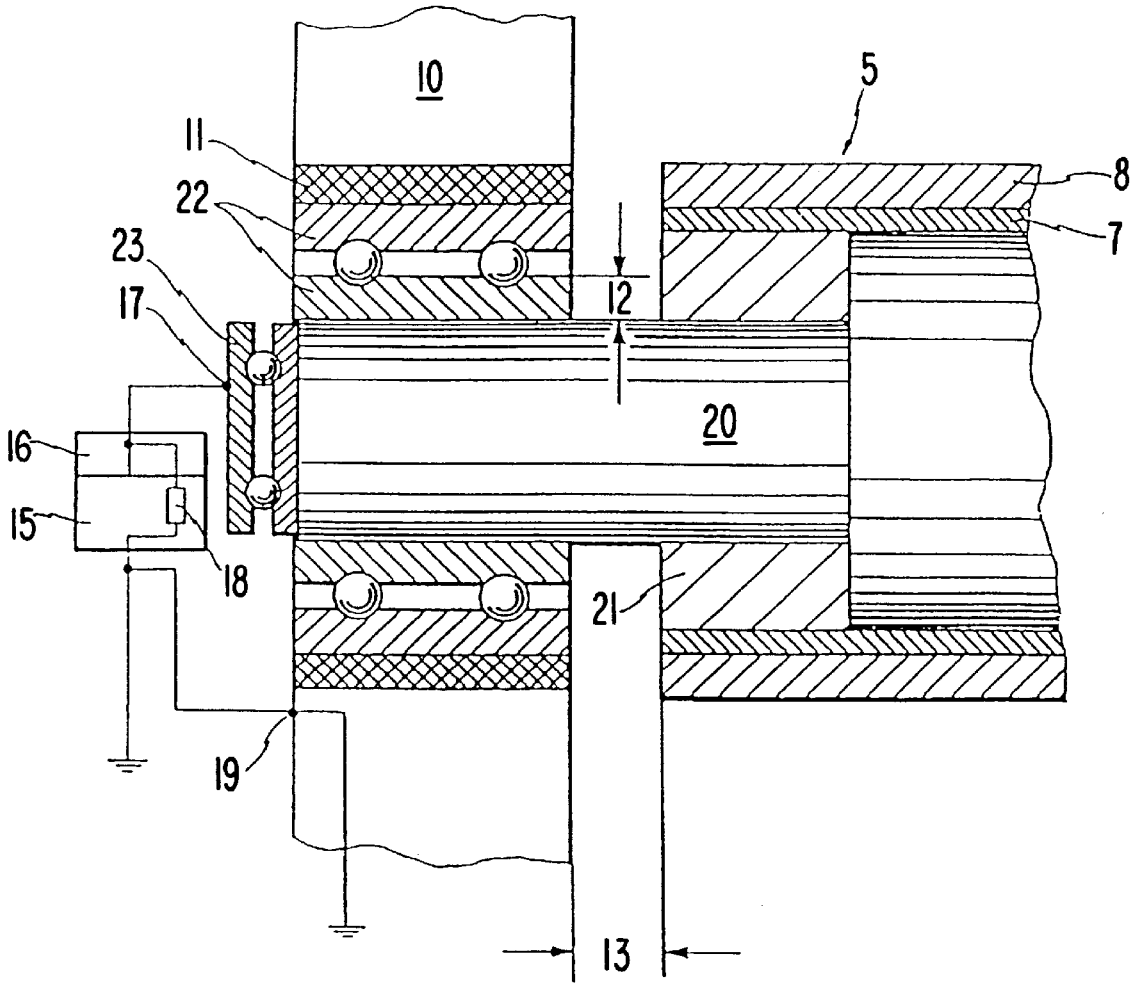
FIG. 2 illustrates a second embodiment of the device according to the invention, with a schematic cross-section and partially truncated illustration.

The embodiment according to FIG. 2 differs from that of FIG. 1, since only one of the two rollers is shown and the spindle 6 therein is constructed now as a shaft 20, which is rigidly joined with the steel jacket 7 via an electrically conductive intermediate piece 21.

On the other hand the shaft 20 is connected to the machine frame 10 either via an electrically insulated ball bearing 22 or a special insulation 11. It is also feasible to use a conventional, electrically conductive ball bearing and to provide between this and the machine frame 10 an electrically insulating sleeve 11.

Furthermore, on the face of the shaft 20 a thrust bearing 23 is provided as a connection, which bearing is electrically conductive and to the external side of which the connection 17 of the high voltage generator 15 is applied via the measuring device 16.

In the case of both embodiments according to FIGS. 1 and 2, it is ensured that the high voltage applied via the spindle 6 or shaft 20 due to the electrical insulation 11 cannot reach the machine frame 10 on the one hand and on the other hand the high voltage can reach from the inside the coating 8 with the limited conductivity of the roller 5.

Figure 3:
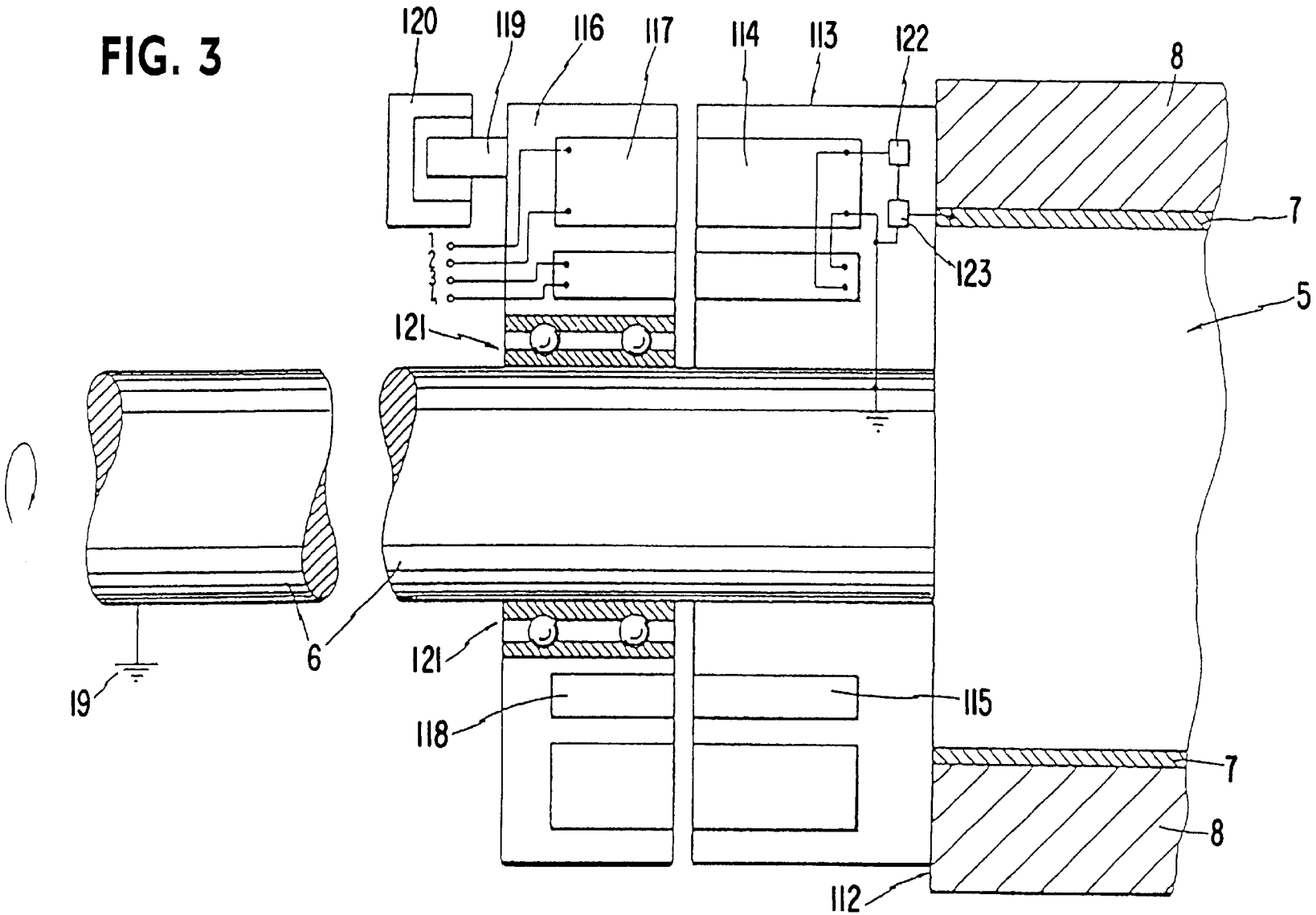
FIG. 3 illustrates a third embodiment of the device according to the invention, with a partially truncated and broken off simplified illustration.

The further, third embodiment according to FIG. 3 also has two rollers forming a gap, however, for the sake of clarity only one roller is shown, as the one described in FIGS. 1 and 2. Furthermore, concentrically with the shaft 6 of the roller 5, next thereto, on one face 112, a first mounting device 113 is provided having a magnetizable core with a secondary coil 114 and a second secondary coil 115, each concentric with the shaft 6.

A further mounting device 116 is provided as a magnetizable core concentrically to the shaft 6 to accommodate a primary coil 117 which is also concentric with the shaft 6 and has electric terminals 1 and 2 as well as a second primary coil 18 provided between the latter and the shaft 6 having electric terminals 3 and 4. The mounting device 116 can rotate relative the shaft 6 by means of spigot 119, which engages the anchorage 120 which is stationary relative to the machine frame and the mounting device has on its inside a ball bearing 121, so that although it can rotate, the magnetizable core can be held in a non-rotating manner relative to the first mounting device 113 by means of the spigot 119 and the anchorage 120.

Further on the secondary side of the first mounting device 113, a rectifier circuit 122 and a smoothing circuit 123 is provided with the output being connected to the coating 8 having a limited conductivity.

The electric terminal 2 of the primary coil 117 is grounded and the electric terminal 1 can be connected to an AC generator. Both electric terminals 3 and 4 of the second primary coil can be connected to the inputs of a regulating circuit, which can modify the size of the output voltage and/or its frequency in a manner known per se.

The secondary coils 114 and 115 are grounded on one side. Both secondary coils 114 and 115 are connected in parallel. Downstream from the two coils, the rectifier circuit 122 is connected for the purpose of rectifying the alternating current. After the rectifier circuit 122, the smoothing circuit 123 functions to eliminate ripple, for example in the form of an LC filter, known per se. The output of the smoothing circuit 123 is connected to the limited conductivity coating 8 of the roller 5.

When being operated, the secondary coil 114 is displaced relative to the primary coil 117. Accordingly, the alternating current of the primary coil 117 can induce a secondary voltage in the secondary coil 114 through the air gap between the two magnetizable cores of the mounting devices 113 and 116. A rectified voltage is produced by the rectifying circuit 122 which rectified voltage is filtered by smoothing circuit 123 to eliminate ripple and applied to the coating 8 having the limited electrical conductivity. The voltage induced in the secondary coil 114 is picked up by the second secondary coil 115 and induced in the second primary coil 118 with a reverse polarity. The electric terminals 3 and 4 can be connected to a regulating circuit. The regulating circuit controls the AC source in such a manner that the limited conductivity coating 8 of the roller 5 always receives the same DC voltage.

Figure 4:
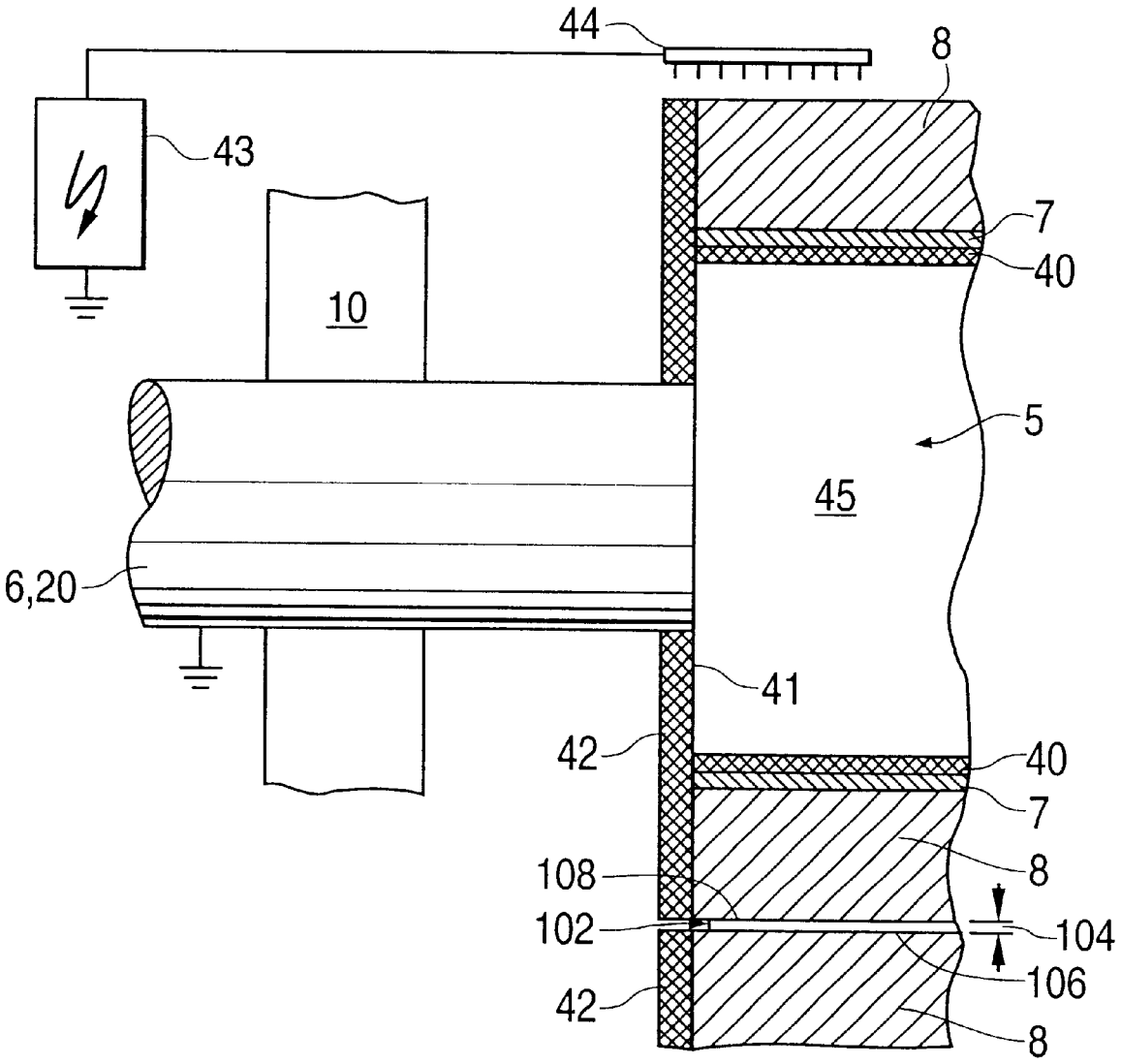
FIG. 4 illustrates a fourth embodiment of the device according to the invention, with a partially truncated and broken off simplified illustration.

The embodiment according to FIG. 4, which only partially illustrates the second roller, differs from the previous embodiments with the shaft or spindle 6 or 20, respectively, directly extending from the machine frame 10. An electrical insulating layer 40 is under the steel jacket 7 of the roller 5. While only part of the lower roller structure is shown, it should be understood that the lower roller is identical to the fully illustrated upper roller. The moving web 102 passes through adjustable gap 104 with outer sides 106 and 108 being charged by corona discharge as discussed below. In addition, the electrical insulating layer 40 extends to both faces 41 which have an insulating layer 42 thereon and which extends in the radial direction from insulating layer 40, to the shaft, spindle, 6 or 20, respectively. The insulating layer 42 can, however, extend up to the outside edge.

A high voltage source 43 is also provided, the output of which is connected to a corona charging electrode 44, which extends essentially parallel to the shaft or spindle, 6 or 20, respectively, in the axial direction. The corona charging layer electrode 44 is situated opposite the limited conductivity coating 8 and charges the opposed outer sides 106 and 108 of the moving web. Thus a charge is produced against the grounded roller core 45, which, due to the highly conductive steel jacket 7, is distributed uniformly over the entire surface, so that the limited electrical conductivity coating 8 can be used for the charging of the material web. In a useful development the roller can also be constructed as an impression cylinder in the gravure printing process, thus forming the electrostatic pressure support.

What is claimed is:

1. A device which electrostatically charges external sides of at least one moving web comprising:

a pair of rollers, each roller having an outer coating of limited electrical conductivity and an inner core in contact with the outer coating with the outer coating of each roller being spaced apart to define a gap through which the at least one moving web passes so that the outer coating of each roller contacts one of the external sides of the at least one web to transfer electrical charge from the outer surface coating to the moving web; and a high voltage power supply which applies electrical charge to each outer coating with one polarity of the power supply being grounded and electrically connected to a part of the core and another polarity of the power supply being electrically connected to a corona charging electrode which transfers the electrical charge to the outer coating of each roller.

2. A device in accordance with claim 1 wherein:

the gap is adjustable.

3. A device in accordance with claim 2 wherein:

the part is electrically conductive.

4. A device in accordance with claim 3 comprising:

an insulating layer radially disposed between the core and the outer coating of each roller.

5. A device in accordance with claim 4 comprising:

a steel jacket radially disposed between the core and the outer coating.

6. A device in accordance with claim 5 wherein:

the steel jacket is radially outside the insulating layer.

7. A device in accordance with claim 1 wherein:

the part is electrically conductive.

8. A device in accordance with claim 7 comprising:

an insulating layer radially disposed between the core and the outer coating of each roller.

9. A device in accordance with claim 8 comprising:

a rotatable member attached to the core.

10. A device in accordance with claim 9 wherein:

the rotatable member is a spindle.

11. A device in accordance with claim 10 wherein:

the rotatable member is a shaft.

12. A device in accordance with claim 8 comprising:

a steel jacket radially disposed between the core and the outer coating.

13. A device in accordance with claim 12 wherein:

the steel jacket is radially outside the insulating layer.

14. A device in accordance with claim 13 comprising:

a rotatable member attached to the core.

15. A device in accordance with claim 14 wherein:

the rotatable member is a spindle.

16. A device in accordance with claim 14 wherein:

the rotatable member is a shaft.

17. A device in accordance with claim 12 comprising:

a rotatable member attached to the core.

18. A device in accordance with claim 17 wherein:

the rotatable member is a spindle.

19. A device in accordance with claim 18 wherein:

the rotatable member is a shaft.

20. A device in accordance with claim 7 comprising:

a rotatable member attached to the core.

21. A device in accordance with claim 20 wherein:

the rotatable member is a spindle.

22. A device in accordance with claim 20 wherein:

the rotatable member is a shaft.

23. A device in accordance with claim 1 comprising:

a rotatable member attached to the core.

24. A device in accordance with claim 23 wherein:

the rotatable member is a spindle.

25. A device in accordance with claim 23 wherein:

the rotatable member is a shaft.

* * * * *